United States Patent [19]

Schlegel et al.

[11] 4,315,627

[45] Feb. 16, 1982

[54] GAME BOARD APPARATUS

[76] Inventors: Ronald L. Schlegel; Francine L. Schlegel, both of 3815 Elston Ave., Oakland, Calif. 94602

[21] Appl. No.: 90,407

[22] Filed: Nov. 1, 1979

[51] Int. Cl.[3] ..... A63F 3/00

[52] U.S. Cl. ..... 273/249

[58] Field of Search ..... 273/242, 243, 248, 249, 273/256

[56] References Cited

U.S. PATENT DOCUMENTS

| | | | |
|---|---|---|---|
| 3,148,885 | 9/1964 | Varlese | 273/256 |
| 3,722,885 | 3/1973 | Leaf | 273/10 R |
| 4,121,823 | 10/1978 | McBride | 273/243 |

OTHER PUBLICATIONS

*Twenty Questions; Book of 1000 Family Games*; ©1971; Reader's Digest.

*Primary Examiner*—Richard C. Pinkham
*Assistant Examiner*—R. Carl Moy
*Attorney, Agent, or Firm*—James E. Toomey

[57] ABSTRACT

Game board apparatus having a board with playing pieces and a series of cards each relating to a public figure, players progress from start towards the finish by attempting to identify the individual public figure who is the subject of the card, then during the course thereof progress about the board. The game is won by the first player to reach the winner's block.

3 Claims, 5 Drawing Figures

GAME BOARD APPARATUS

BACKGROUND OF THE INVENTION

The present invention relates to a board game apparatus for use in playing a game which relies on the knowledge, intelligence and general information concerning well known historical and public figures possessed by the players.

Two to six players can conveniently play the game and derive entertainment and knowledge therefrom. According to the game a player progresses from start to finish about a delineated path on the surface of the game board.

Prior art patents relating to game board apparatus are U.S. Pat. No. 2,026,082 to Darrow relating to Monoply; U.S. Pat. No. 4,032,154 to Magiera relating to business transactions; U.S. Pat. No. 4,089,527 to Roth relating to a memory type board game for conducting business transactions; U.S. Pat. No. 4,136,881 to Anspach relating to business development and real estate trading and U.S. Pat. No. 4,140,319 to Aycock et al also relating to real estate transactions.

None of the foregoing patents relate to a game which is based on the use of a plurality of well known figures in various categories of activity which individuals have to be identified in order to complete the game.

SUMMARY OF THE INVENTION

By the present invention a game board with start and finish points or blocks, and intermediate clue spaces, is provided along with cards describing well-known public figures or Characters falling into general categories of activities such as history, literature and the like. Each category comprises on the order of fifty cards with information and clues identifying, and describing by information generally known to the public, the Character that is the subject matter of the card.

By conventional means a lead player is selected who then selects a category of public personage and a single card from such category. The identity of the public figure who is the subject of the card is not revealed to the players and by a series of questions which arise from guesses, intuition, knowledge, deduction and other exercise of a player's wit, the players attempt to identify the Character. In the process all players compete to progress from the starting block to the winner's block on the game board while utilizing conventional playing pieces to identify their location in the course of the game.

DESCRIPTION

Figure 1:
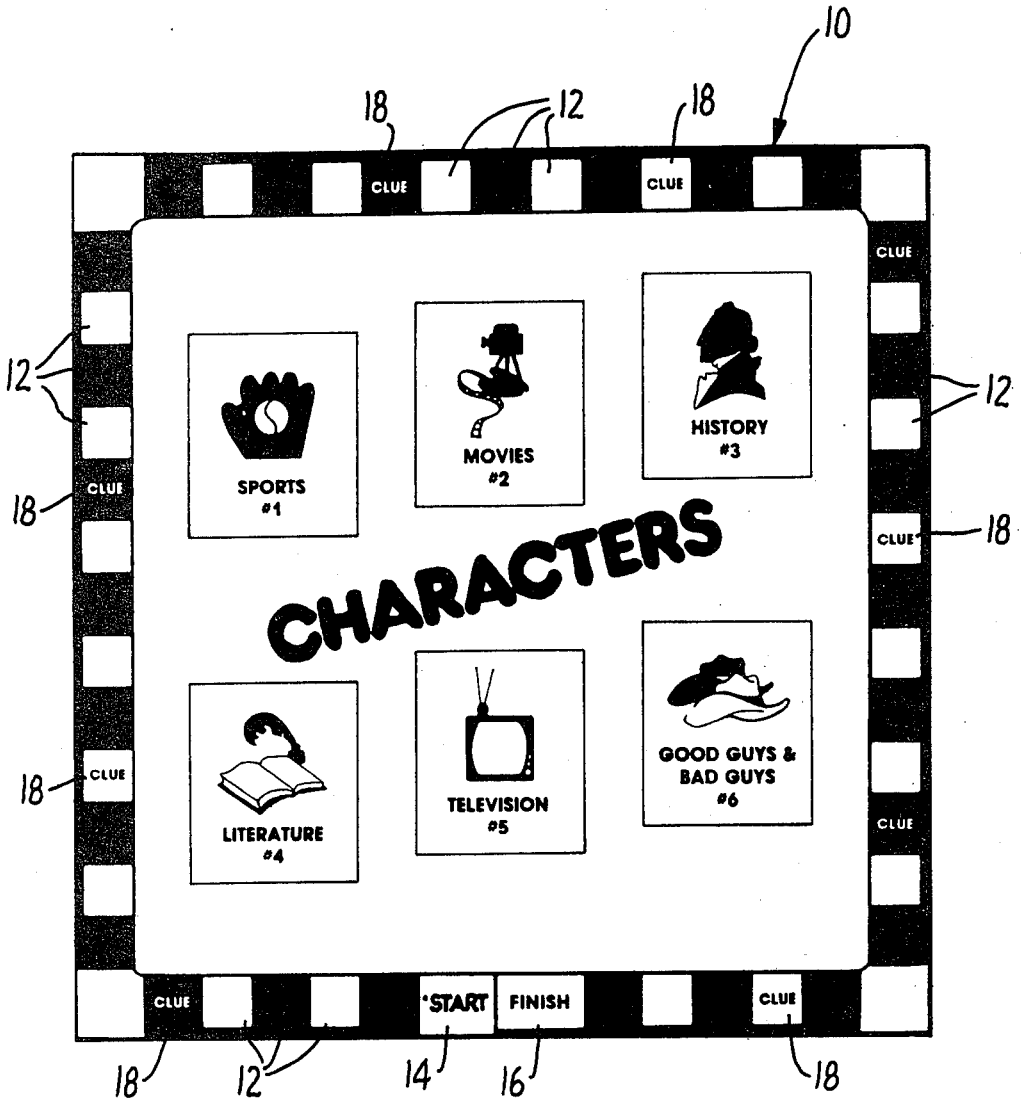
FIG. 1 is a top plan view of a game board according to the present invention showing the start and finish of the course to be followed by the players, including Clue spaces.

In FIG. 1 game board 10 comprising the board apparatus of the invention is shown. Board 10 includes a plurality of blocks, marked spaces or other areas 12 forming a path from starting block 14 and continuing about board 10 to the finish space or win block 16.

At selected points along the path between the starting block 14 and winning block 16 are clue blocks 18. In the embodiment shown clue blocks 18 are for the most part located five spaces from each other and from starting block 14. These distances between clue spaces can also be varied.

The cards 26 (see FIG. 2) in the preferred embodiment describe personages or Characters who fall into six general categories whereby they are identified by the public. These categories in the presently described invention comprise historical figures or other well-known figures in sports, movies, history, literature, television and heroes or villians, as the case may be. The last group (heroes and villians) are referred to in the game as Good Guys and Bad Guys.

Figure 3:
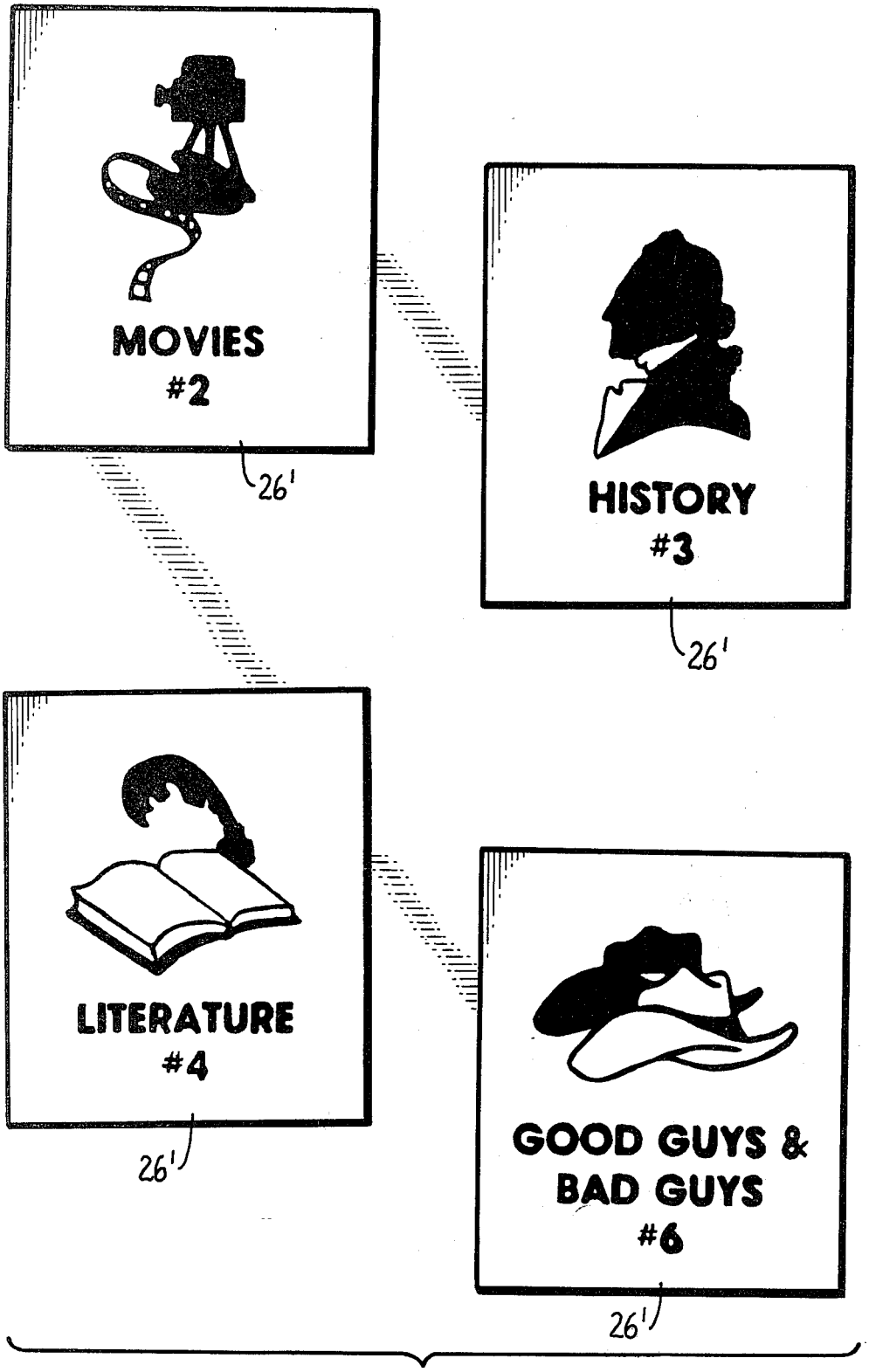
FIG. 3 is a similar view of the reverse side or back of the cards of FIG. 2.

FIG. 3 discloses the reverse side 26' of card 26 and shows one manner whereby the category of card representing the personage concerned is identified.

In the preferred embodiment of the game 300 cards are employed with 50 cards in each category. The following are partial lists of the Characters or personages falling within each of the respective categories:

| | |
|---|---|
| **SPORTS CATEGORY** | |
| James Corbett | Leroy (Satchel) Page |
| "Dizzy" Dean | Jackie Robinson |
| Walter Johnson | George Herman (Babe) Ruth |
| Rocky Marciano | John L. Sullivan |
| Bronko Nagurski | Jim Thorpe |
| **MOVIE CATEGORY** | |
| Humphrey Bogart | Clark Gable |
| Charlie Chaplin | Frederic March |
| Gary Cooper | James Stewart |
| Joan Crawford | Spencer Tracy |
| Walt Disney | John Wayne |
| **HISTORY CATEGORY** | |
| Susan B. Anthony | Robert Kennedy |
| Marie Antoinette | Abraham Lincoln |
| Aristotle | Douglas MacArthur |
| Napoleon Bonaparte | Will Rogers |
| William Jennings Bryan | Franklin Roosevelt |
| **LITERARY CATEGORY** | |
| Agatha Christie | James Joyce |
| Charles Dickens | Rudyard Kipling |
| F. Scott Fitzgerald | Jack London |
| Victor Hugo | H.L. Mencken |
| Samuel Johnson | George B. Shaw |
| **TELEVISION CATEGORY** | |
| James Arness | Groucho Marx |
| Jack Benny | Edward R. Murrow |
| Buddy Ebsen | Diana Rigg |
| Dave Garroway | Ed Sullivan |
| Arthur Godfrey | Jack Webb |
| **THE GOOD GUYS AND THE BAD GUYS CATEGORY** | |
| John Wilkes Booth | Professor James Moriarty |
| Lizzie Borden | Audie Murphy |
| Marcus Junius Brutus | Robin Hood |
| Al Capone | Satan |
| Sherlock Holmes | Sergeant Alvin York |

Figure 4:
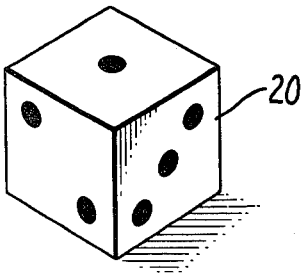
FIG. 4 is a perspective view of a standard die.
Figure 5:
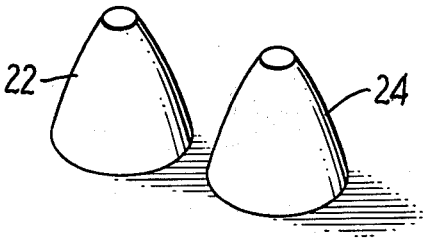
FIG. 5 is a perspective view of typical tokens or other devices or pieces utilized by the various players of the game each playing piece having different colors or symbols which distinguish one from another.

FIG. 4 discloses the standard die normally used to determine which player will commence play and which category will be selected. In lieu of the die a spinner dial and card, or any other convenient means for making the foregoing selection can be used whereby one player may receive a higher number than the other players.

The tokens or pawns 22 and 24 represent one form of playing piece which each individual player uses in the game. Conveniently they may be of differing colors to distinguish one from another. Numbers, modified shapes, or symbols, or other means can also be used to distinguish the various pieces.

OPERATION OF THE ABOVE DESCRIBED PREFERRED EMBODIMENT

The objective of the game of the present invention is for a plurality of players, each represented by a marker 22 or the like, to progress from the starting block 14 about the game board in the manner described below and for one of them to arrive first at the Finish or Winners block 16. The players advance around the board from space to space by virtue of their role as a Character and by wit, guesses, interrogation and deduction in determining the identity of the personages or Characters who may be the subject of the game. A player may advance on the basis of specific knowledge involved, and intuition applied, in identifying a particular Character.

As heretofore stated, a plurality of players may participate. However, at least two and no more than six are desirable in order for the game to progress at a rate that will maintain the interest of all of the players.

In the embodiment shown, the die 20 is thrown by each player and the one receiving the highest number will assume the role of the Character and will thereafter lead the play while in such role. The Character shakes the die again to select the category of the cards to determine the person whose identity he will assume in his role as Character. As above stated, the numbers which have been assigned to identify each category in the present embodiment are as follows:

No. 1 Sports
No. 2 Movies
No. 3 History
No. 4 Literature
No. 5 Television
No. 6 Good Guys & Bad Guys (heroes and villians)

In a typical example the player may shake and roll the die and receive the number two which is the Movie Category. He thereupon selects a card from the stack of Category No. 2 cards relating to Movie Characters.

Each player meanwhile has his token in the start space 14 and the Character advances his token ten spaces from the start.

Thereupon, the other players must identify the particular Character which is the subject of the selected card.

For example, the card may be that identifying Clark Gable.

The players are allowed a total of twenty questions to identify each Character. The process of identification is by a series of questions asked by each of the other players. Generally the order of play is in a clockwise direction. If the players are unable to identify the Character who is the subject of the card the player holding the Character card may advance ten spaces. The player thereupon selects another card from the same or another category in the manner heretofore described.

The other players attempt to identify the Character by asking questions which may be solely a guess or which may be based on detailed knowledge of the Character to be identified, or deduction, or intuition, whether or not based on the information developed during the questioning period. The question by each player is put in the order of their right to play and each question is answered by the player who is the Character and the holder of the Character card. If the answer is in the affirmative the questioning player advances one space and has the right to continue to question until the answer is in the negative. Thereupon it is the turn of the next player in the predetermined order of play.

In a typical example the line of questions may be as follows:

"Are you living?" "Yes"
"Are you female?" "No"
"Are you in comedy?" "Yes"
"Are you a talk show host?" "Yes"
"Have you ever hosted the Academy Awards?" "Yes"

A player may thereupon name Johnny Carson at which point he would have correctly named the Character.

The face side 26 of each Character card has three clues as heretofore mentioned. When any player advances to a clue space or block the player holding the Character card reads aloud to all the players a clue from the card that is then in play. The clues are presented in the order in which they are listed on the card as the right to receive the clue accrues in the regular order of play.

Figure 2:
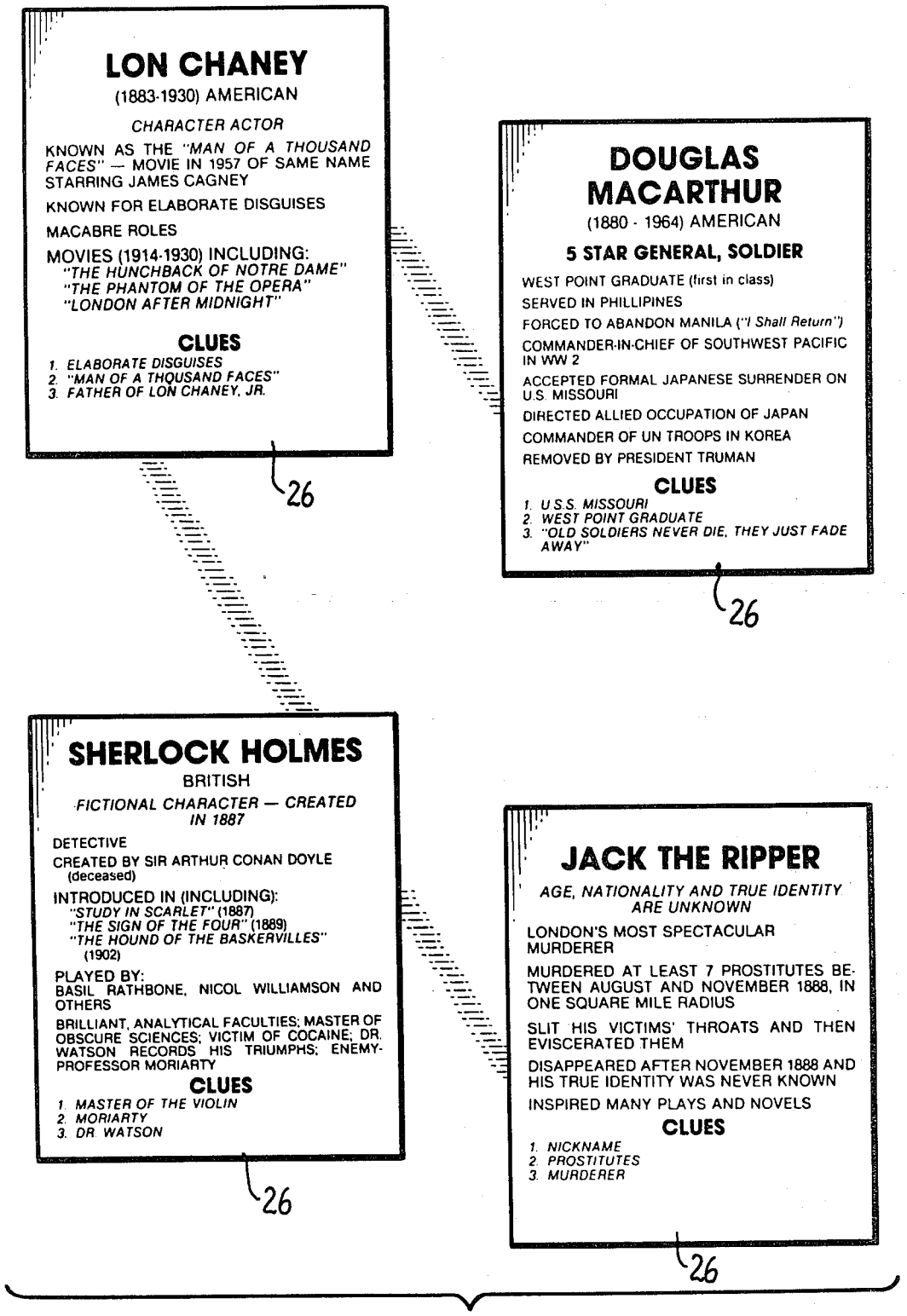
FIG. 2 is a top plan view of the face of a variety of cards which are typical of those employed in the game and each of which identify and contain clues respecting public figures and other personages included in the Character cards.

As will be noted by FIG. 2, each Character has three clues which are described in a manner well known to members of that sector of the public who are familiar with the category into which the Character card falls. Accordingly, as previously stated, when any player advances in normal manner to a clue space the appropriate clue is read aloud to all the players from the Character card. For example, clue number 1 for "Clark Gable" is "Has won an Academy Award". The sole purpose of the clue is to enable the identification of the Character. If the Character is not identified it has no effect on the progression of any of the players about the board. The clues become more descriptive and the Character more easily identifiable with each progressive clue, that is, #2 is more readily associated with the Character and #3 is still easier.

Any player that has advanced five spaces from the starting block may at any time challenge the player holding the Character card by calling at any time regardless of turn. Such challenge is made on the belief that the player knows the identity of the Character.

The challenge is made by stating "I challenge" and the player thereupon has a free guess as to the identity of the Character.

If the challenger is correct he will become the new Character and may advance his token ten spaces and then shake the die to select a category of Character cards.

If the challenge is incorrect the player is penalized by moving the token back five spaces and play continues with the person whose turn it was before the challenge.

When a player has advanced to any block within the last ten spaces before the winning block he can win the game only by guessing the identity of the Character card which is then in play. A player cannot advance in the winner's circle merely with a "yes" answer. For example, a player may be on the final space and another player ten or less spaces behind and spaced from the winner's circle. The latter player may win the game if he guesses the Character and thereby passes the other player who is only one space from the winner's circle.

The basic teachings of the present invention has been explained above. Many extensions and variations will be obvious to one having ordinary skill in the art. For example, the length of the game board and the distance from the starting block to the winner's circle may be modified. The Characters may be substituted so long as the information relating to each Character is accurate, factual and generally known to that segment of the public in which a particular public figure may be classified or categorized. Likewise, the particular categories of prominent historical and public figures who are the subject of the Character cards may be changed and new classifications or categories such as musicians, artists, or biblical figures and many others can be used.

What is claimed is:

1. Game Apparatus comprising:

a board having a plurality of spaced areas defining a path delineated on the board, one of said areas representing the starting block and another of said areas representing a finish block, other of said spaced areas being designnated as special areas and having characteristic indicia thereon;

a plurality of differently identified playing pieces each of which is to be assigned to separate players;

a plurality of cards each of which cards describes on the obverse thereof certain generally known published activities of a well known public figure, a portion of said description organized under a heading denoted by indicia corresponding to said special area indicia, whereby a further portion of said description organized under said heading is disclosed to a player whose token lands on one of said special areas, and whereby said activities permit each card relating to said public figure to be classified into one of several different categories of general activity each of said cards in a particular category having indicia on the reverse thereof common to the reverses of all said cards in that category;

means for determining the order of play among said players and for the selection of one of said categories of general activity from said cards, said determining means comprising means for outputting indicia corresponding to the indicia on the reverse of said cards, whereby said players are enables to select a particular card and a card holder therefor from said players and to thereby permit said other players to determine the identity of the subject public figure of said card while at least one player is enabled to progress from said starting area to said finish block.

2. The game apparatus of claim 1 wherein each of said cards includes factual material well known to those members of the public generally familiar with the category which encompasses the public figure that is the subject matter of each particular card.

3. The game apparatus of claim 1 wherein each of said cards includes brief references to events or activities of said public figure whereby at least one of said players are enabled to identify said public figure that is the subject matter of a particular card.

* * * * *